United States Patent [19]

Michlovic

[11] Patent Number: 4,843,791

[45] Date of Patent: Jul. 4, 1989

[54] CAP FITTING FOR GASKET SYSTEM INTERSECTIONS

[75] Inventor: John J. Michlovic, Avon Lake, Ohio

[73] Assignee: The Standard Products Company, Cleveland, Ohio

[21] Appl. No.: 114,579

[22] Filed: Oct. 29, 1987

[51] Int. Cl.[4] ..... E04H 1/00

[52] U.S. Cl. ..... 52/235; 52/395; 52/398; 52/467

[58] Field of Search ..... 52/235, 242, 236.3, 52/483, 466, 467, 469, 456, 395, 398, 465, 403, 772, 403, 509

[56] References Cited

U.S. PATENT DOCUMENTS

| | | | |
|---|---|---|---|
| 1,812,009 | 6/1931 | Lenke | 52/395 |
| 2,769,212 | 11/1956 | Hammitt et al. | 52/150 |
| 3,084,483 | 4/1963 | Cipriani et al. | 52/395 |
| 4,418,506 | 12/1983 | Weber et al. | 52/398 X |

*Primary Examiner*—Henry E. Raduazo
*Assistant Examiner*—Creighton Smith
*Attorney, Agent, or Firm*—Harness, Dickey & Pierce

[57] ABSTRACT

A joint fitting to position about the intersection of at least two gasket strips is disclosed. The fitting includes a first rigid member and second elastic member to cover the intersection of two or more gasket strips. The second elastic member is positioned over the intersection of the two or more gasket strips. The first rigid member is positioned over the second elastic member at the intersection of the two or more gasket strips. A mechanism to secure the first and second members onto the two or more gasket strips is coupled with the first and second members such that the first rigid member exerts force upon the second elastic member and two or more gasket strips to effectively seal the intersection of the two or more gasket strips.

14 Claims, 2 Drawing Sheets

CAP FITTING FOR GASKET SYSTEM INTERSECTIONS

BACKGROUND AND SUMMARY OF THE INVENTION

The present invention relates to curtainwall gasket systems. More particularly, the invention relates to fittings to secure vertical and horizontal gasket strips in position at their intersections on a curtainwall.

In curtainwall systems that utilize resilient neoprene gaskets to retain glass panels within openings in the building, the gaskets are ordinarily formed by a vulcanizing process to create a large ladder gasket. While the ladder gasket proves satisfactory to the building industry to retain the glass panels, designers are always looking for improvements in the field. Ladder gaskets involve all vulcanized intersections or corners which increases the overall expense to manufacture the gasket, which must be molded at the factory. Large ladder gaskets weigh a substantial amount and are difficult to maneuver by glazers when they are positioning the gasket into the retaining frame on the building. The ladder gasket must be hung one "rung" or strip at a time and a good majority of the anchoring splines of the strips and corners must be inserted into the aluminum framing at one time to "hold up" the ladder gasket on the building.

The present invention provides a fitting which is positioned over intersections of vertical and horizontal gasket strips. The present invention may be used on L-shaped, T-shaped or cross (+) shaped intersections of the gasket strips. Different types of fittings which position over intersections of gasket strips are present in the art. U.S. Pat. No. 2,842,073, issued July 8, 1958 to Huston et al; and U.S. Pat. No. 3,312,026, issued Apr. 4, 1967 to Rolland illustrate current art.

The above-identified patents, however, have several disadvantages. One disadvantage is that the devices are very complicated in use. Another disadvantage is that an opening is created underneath the fitting, enabling precipitation such as rain, snow, or the like to seep into the intersection of the strips causing the glass panels to leak.

Accordingly, it is an object of the present invention to overcome the disadvantages of the above art. The present invention provides the art with a fitting that eliminates vulcanizing and exact measuring of conventional ladder gaskets. The present invention enables gasket strips to be cut to length and shipped to the consumer. Also, the present invention enables foam or the like to be injected at the intersection of the gasket strips underneath the fitting to enhance elimination of precipitation collection at the intersection of the gaskets thus, enhancing sealing and eliminating leaking at the intersections.

The present invention provides the art with a new and improved joint fitting for resilient gasket glazing systems. The joint fitting includes a first rigid member and second elastic member to cover the intersection of two or more gasket strips. The second elastic member is positioned over the two or more strips at their intersection. The first rigid member is positioned over the second elastic member at the intersection of the two or more gasket strips. A mechanism to secure the first and second covering members onto the two or more gasket strips is coupled with the two members such that the first member exerts force onto the second member and the two or more gasket strips to effectively seal the intersection. Optionally, a polymeric foam may be inserted under the two members through an aperture in the members at the intersection of the two or more gasket strips. The foam rises, cures and secures to the two or more gasket strips to further affect the seal of the fitting with the gasket strips.

From the subsequent description and the appended claims taken in conjunction with the accompanying drawings, additional objects and advantages of the present invention will become apparent to one skilled in the art.

DETAILED DESCRIPTION OF THE PREFERRED EMBODIMENT

Figure 1:
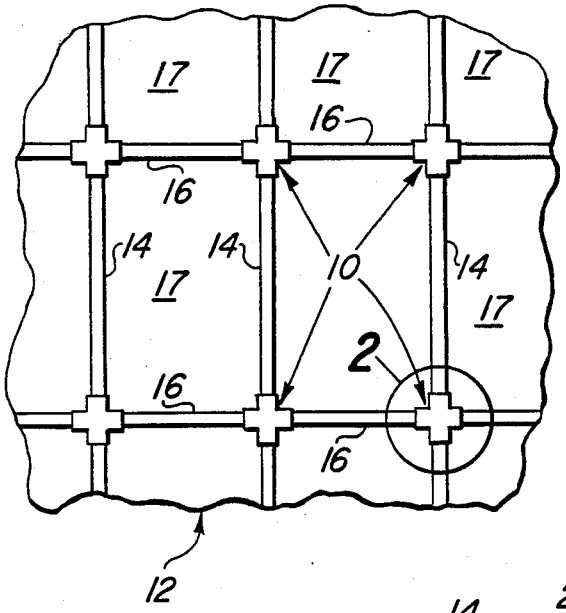
FIG. 1 is a partial elevational view of a curtainwall system including joint fittings in accordance with the present invention.
Figure 2:
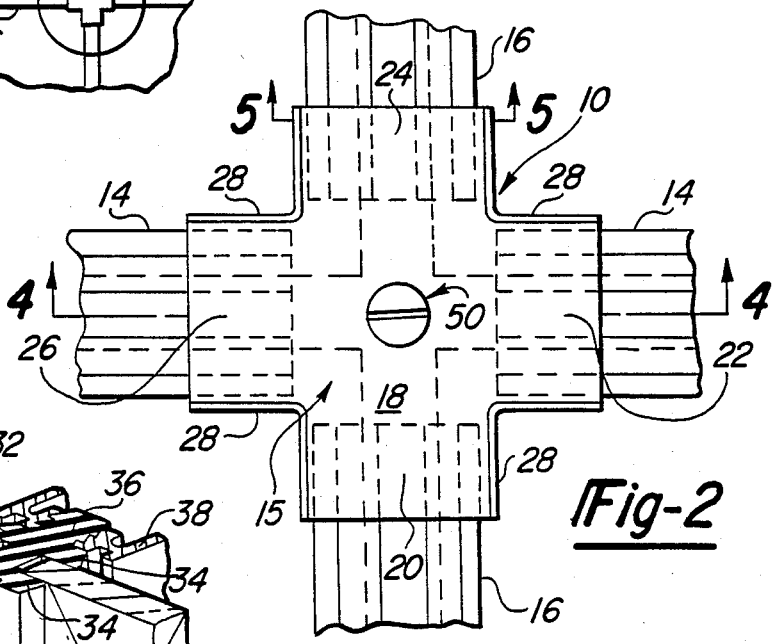
FIG. 2 is an enlarged view of FIG. 1 within circle 2.
Figure 3:
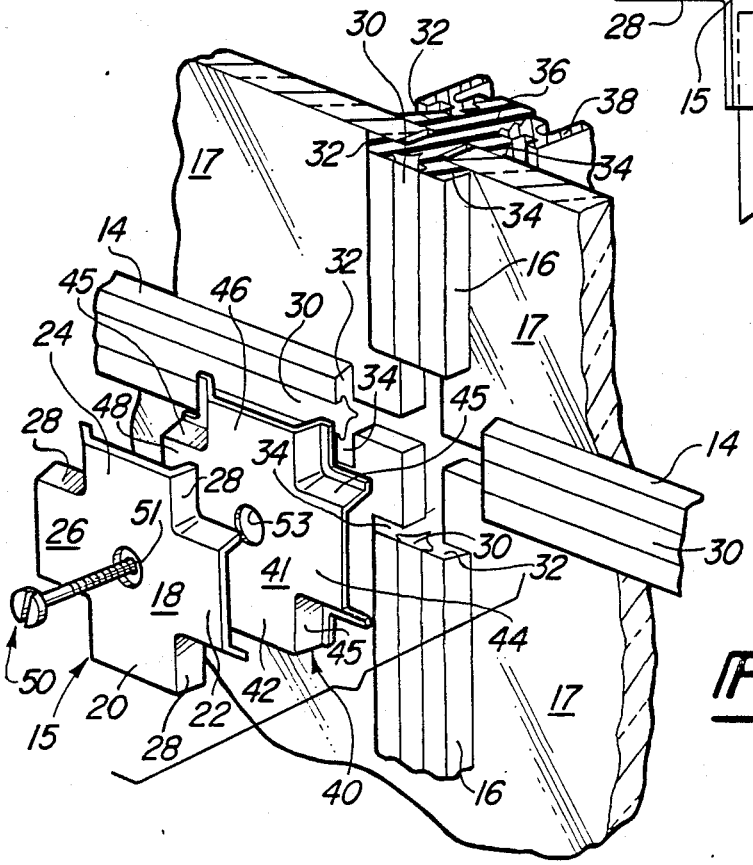
FIG. 3 is an exploded perspective view of FIG. 2.
Figure 4:
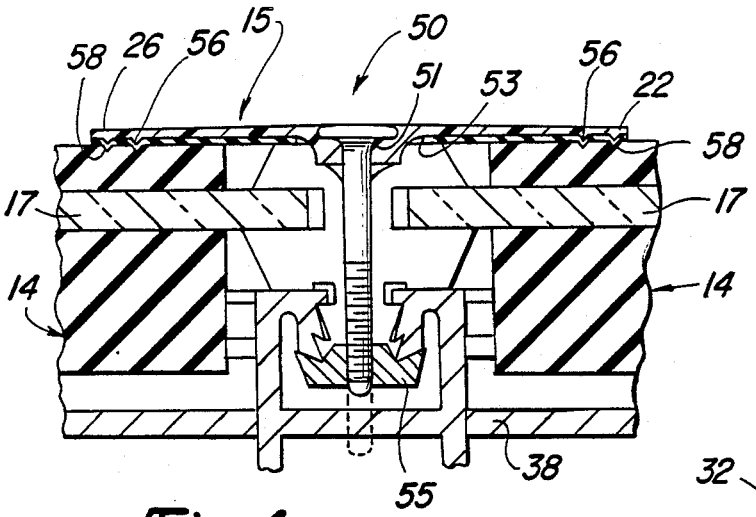
FIG. 4 is a cross-sectional view of FIG. 2 along line 4—4 thereof.
Figure 5:
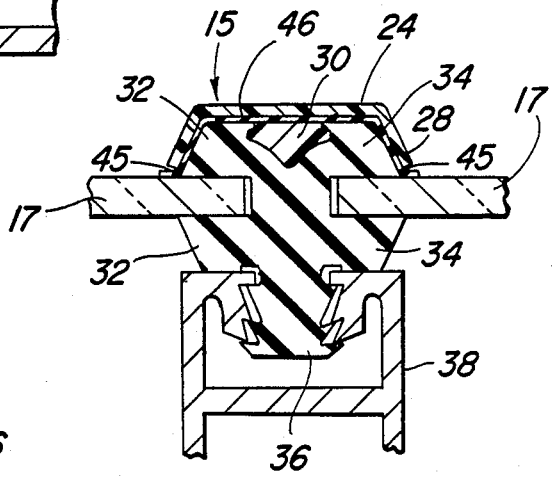
FIG. 5 is a cross-sectional view of FIG. 2 along line 5—5 thereof.

Referring to the Figures, particularly FIG. 1, several joint fittings are shown and designated with the reference numeral 10. The joint fittings are illustrated in a curtainwall 12 having several vertical and horizontal gasket strips 14 and 16, respectively.

Moving to FIGS. 2 through 5, a better understanding of the joint fitting 10 may be procured. The joint fitting 10 includes a first rigid member 15 having a body portion 18 and a plurality of legs 20, 22, 24 and 26. It will be noted that in the drawings the joint fitting first rigid member 15 includes four legs, however, the joint fitting may have two legs and form an "L" or three legs to form a "T" when two or three, respectively, strips intersect. Skirts 28 depend from the legs 20, 22, 24 and 26 to conform with the gasket strips 14 and 16 at their intersection. The skirts 28 further enhance the securing and sealing of the glass 17 at the intersection.

The vertical and horizontal gasket strips 14 and 16 are substantially identical. The gasket strips 14 and 16 include a locking strip member 30 to lock the glass panels 17 between wings 32 and 34 of the gaskets 14 and 16. The gaskets 14 and 16 include an anchoring spline 36 to secure the gasket strips 14 and 16 to a frame member 38.

A second elastic member 40 is positioned directly on top of the intersection of the gasket strips 14 and 16 to seal their intersection. The second elastic member 40 generally includes a body 41 and a plurality of legs 42, 44, 46 and 48 and has substantially the same shape as that of the first member 15. The second elastic member 40 also includes contoured skirts 45 between the legs 42, 44, 46 and 48, and is manufactured from an elastic polymeric material.

Alternatively, the second elastic member 40 may be integral with the first rigid member 15 and provide the system with a single rigid fitting. In this case, an elastomeric material may be sprayed or the like directly onto the underside of the rigid member 15. The elastomeric material provides the rigid member with desired characteristics.

A fastening mechanism 50 to secure the first and second members 15 and 40 of the joint fitting 10 onto the support 38 passes through apertures 51 and 53 in the first and second members 15 and 40. The securement mechanism 50 may be of a nut and bolt type of device with a retaining nut 55 secured within the support 38. An alternative means would be to utilize a longer screw without a nut and secure the screw directly into the retainer, as seen in phantom in FIG. 4.

Each first rigid leg 20, 22, 24 and 26 includes at least one vane 56 and preferably two 56 and 58. The vanes 56 and 58 project into the elastic member 40 and gasket strips 14 and 16 to enhance the sealing of the joint fitting 10 onto the gasket strips 14 and 16.

Generally, the vertical and horizontal gasket strips are abutted as close to one another as possible, however, a gap is generally formed underneath the body 18 and 41 of the first and second members 15 and 40. Ordinarily, an aperture (shown in phantom) is bored through the first and second members 15 and 40 large enough to enable a nozzle to be inserted through the apertures to enable polymeric foam or other sealant to be injected into the gap at the intersection. The foam or sealant is injected into the intersection, cures, and bonds itself to the gasket strips and also to the second member 40. The foam or sealant fills the gap beneath the joint fitting bodies to reduce the possibility of entry of air or water at the intersection to eliminate leaking.

Generally, the fastening mechanism is tightened such that the first rigid member 15 applies pressure onto the second elastic member 40 and gasket strips 14 and 16 to seal the joint fitting 10 against the gasket strips 14 and 16. The more the fastener is tightened, the more pressure that is exerted onto the second elastic member 40 and gasket strips 14 and 16, forcing the vanes 56 and 58 into the same to effectively seal the intersection of the gasket strips 14 and 16.

Figure 6:
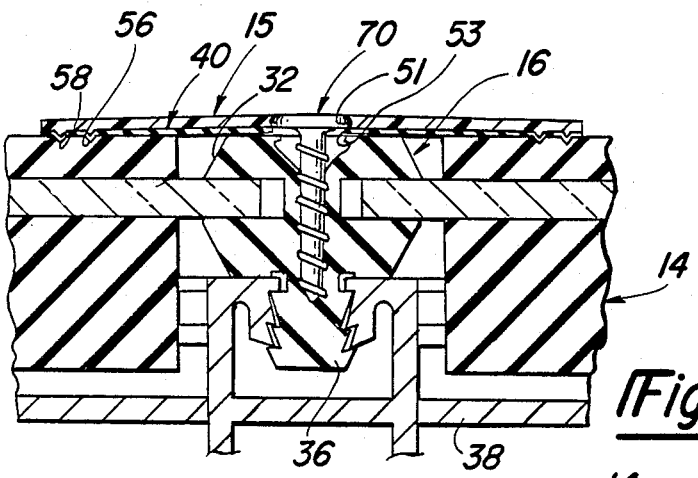
FIG. 6 is a cross-sectional view similar to FIG. 4 of a second embodiment of the present invention.
Figure 7:
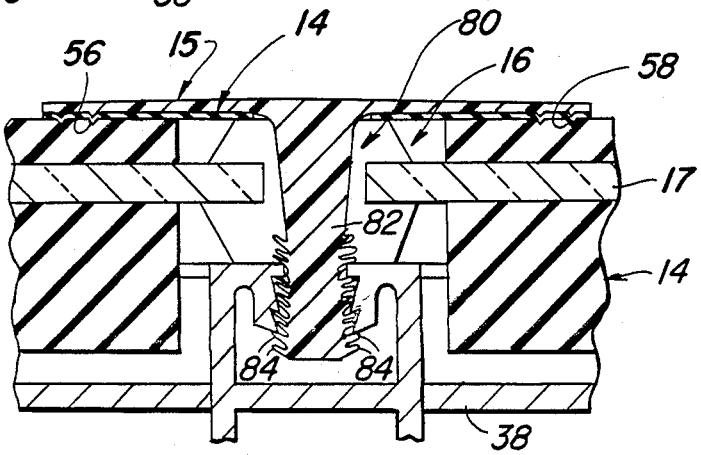
FIG. 7 is a cross-sectional view similar to FIG. 4 of another embodiment of the present invention.

FIGS. 6 and 7 illustrate additional embodiments of the fastening member.

FIG. 6 illustrates a fastening mechanism having a screw 70 that is screwed directly into one of the gasket strips that runs continuously underneath the body of the locking fitting 10. The screw 70 is tightened into the gasket material thereby forcing the rigid first member 15 against the second elastic member 40 and gasket strips 14 and 16 to effectuate the seal as explained herein.

FIG. 7 illustrates a friction spline fastener 80. A spline 82 is inserted into the spline receiving portion of the support 38 to fasten the first rigid member 15 onto the second elastic member 40 and intersection of the gasket strip 14 and 16. The spline 82 has several fingers 84 which project therefrom so that the spline 82 may be forced further into the support member 38 to increase the pressure on the second elastic member 40 and gasket strips 14 and 16 to effectuate the seal as explained herein.

While the above discloses the preferred embodiment of the present invention, it will be understood that modifications, variations, and alterations may be made to the present invention without varying from the scope and fair meaning of the subjoined claims.

What is claimed is:

1. A joint fitting for a resilient gasket glazing system comprising:

first rigid means adapted for covering an intersection of two or more gasket strips, said first rigid means comprised of a substantially planar body member having at least two leg portions extending from its sides, said leg portions being continuous with said body member and in substantially the same plane as said body member and adapted for covering the gasket strips and at least one of said legs being positioned transverse to the other legs;

second elastic means adapted for covering said intersection of two or more gasket strips, said second means adapted to be positioned between said two or more gasket strips and said first means at said intersection, said second elastic means comprised of a substantially planar body member having at least two leg portions extending from its sides, said leg portions being continuous with said body member and in substantially the same plane as said body member and adapted for covering the gasket strips and at least one of said legs being positioned transverse to the other legs; and means for securing said first and second covering means on said two or more gasket strips such that said first means exerts force onto said second means and two or more gasket strips to effectively seal the intersection of said two or more gasket strips.

2. The joint fitting according to claim 1 wherein each said leg portion of said first rigid means includes at least one projecting vane to enhance the sealing of said first rigid means on said second elastic means and gasket strips.

3. The joint fitting according to claim 1 wherein said means for securing said first and second means includes a threaded fastener and a threaded fastener receiving retainer, said fastener and retainer coupled with a frame structure for maintaining the gasket strips in position at their intersection.

4. The joint fitting according to claim 1 further comprising sealant means positioned at the intersection of said gasket strips for further enhancing the sealing of said gasket strips.

5. The joint fitting according to claim 1 wherein a skirt depends from said leg portions to enhance sealing of said gasket strips.

6. The joint fitting according to claim 1 wherein said first rigid means and second elastic means both include three leg portions and have an overall T-shape.

7. The joint fitting according to claim 1 wherein said first rigid means and second elastic means both include four leg portions and have an overall cross-shape.

8. The joint fitting according to claim 1 wherein said first rigid means and second elastic means both include two leg portions and have an overall L-shape.

9. The joint fitting according to claim 1 wherein said first rigid means and second elastic means both include two leg portions and have an overall straight line shape.

10. A glazing system comprising:

a plurality of gasket strips;

a frame network defining a curtain wall with intersecting vertical and horizontal frame member, each member including means for receiving said gasket strips;

a plurality of glass panels positioned into said gasket strips such that the perimeter of the glass panels is secured by said gasket strips;

a plurality of fittings for securing the intersections of said gasket strips, each fitting comprising:

a first rigid means covering the intersection of two or more of said gasket strips, said first rigid means comprised of a substantially planar body member having at least two leg portions extending from its sides, said leg portions being continuous with said body member and in substantially the same plane as said body member and adapted for covering the gasket strips and at least one of said legs being positioned transverse to the other legs;

a second elastic means covering said intersection of two or more of said gasket strips, said second elastic means positioned between said two or more gasket strips and said first rigid means at said intersections, said second elastic means comprised of a substantially planar body member having at least two leg portions extending from its sides, said leg portions being continuous with said body member and in substantially the same plane as said body member and adapted for covering the gasket strips and at least one of said legs being positioned transverse to the other legs; and means for securing said first and second covering means on said two or more gasket strips such that said first rigid means exerts force onto said second elastic means and two or more gasket strips to effectively seal the intersections of said two or more gasket strips.

11. The glazing system according to claim 10 wherein each said leg portion of said first rigid means includes at least one projecting vane to enhance the sealing of said first rigid means on said gasket strips.

12. The glazing system according to claim 10 wherein said means for securing said first and second means includes a threaded fastener and a threaded fastener receiving retainer, said fastener and retainer coupled with a frame structure for maintaining the gasket strips in position at their intersection.

13. The glazing system according to claim 10 further comprising foam means positioned at the intersection of said gasket strips for further enhancing the sealing of said gasket strips.

14. The glazing system according to claim 10 wherein a skirt depends from said leg portions to enhance sealing of said gasket strips.

* * * * *